United States Patent [19]

Page

[11] Patent Number: 4,770,849

[45] Date of Patent: Sep. 13, 1988

[54] DYNAMICALLY LOADING SOLID MATERIALS OR POWDERS OF SOLID MATERIALS

[75] Inventor: Neil W. Page, St. Lucia, Australia

[73] Assignee: University of Queensland, Queensland, Australia

[21] Appl. No.: 934,557

[22] PCT Filed: Mar. 4, 1986

[86] PCT No.: PCT/AU86/00050

§ 371 Date: Oct. 22, 1986

§ 102(e) Date: Oct. 22, 1986

[87] PCT Pub. No.: WO86/05131

PCT Pub. Date: Sep. 12, 1986

[30] Foreign Application Priority Data

Mar. 4, 1985 [AU] Australia ..... PG9557

[51] Int. Cl.[4] ..... B22F 7/00

[52] U.S. Cl. ..... 419/66; 264/113; 264/84; 425/355; 425/405.2; 425/1; 419/8

[58] Field of Search ..... 72/429, 56, 253.1; 419/48, 66, 8; 264/109, 113, 119, 122, 40.5, 84, 60; 425/355, 405 H, DIG. 28, 406, 77

[56] References Cited

U.S. PATENT DOCUMENTS

| | | | |
|---|---|---|---|
| 1,951,174 | 3/1934 | Simons | 419/8 |
| 3,065,073 | 11/1962 | Hug | 419/8 |
| 3,084,398 | 4/1963 | Swed | 425/405 H |
| 3,356,496 | 12/1967 | Hailey | 419/8 |
| 3,657,917 | 4/1972 | Chelminski | 72/253.1 |
| 4,049,367 | 9/1977 | Tominaga et al. | 72/56 |
| 4,255,374 | 3/1981 | Lemcke et al. | 264/113 |
| 4,384,834 | 5/1983 | Wichoud | 425/355 |

*Primary Examiner*—David Jones

*Attorney, Agent, or Firm*—Foley & Lardner, Schwartz, Jeffery, Schwaab, Mack, Blumenthal & Evans

[57] ABSTRACT

Solid materials are dynamically loaded by impact with a piston (10) fired at the material (11) in a suitable support (12) wherein a "punch", (22) a body of material introducing an impedance mismatch, is inserted between the piston (10) and the material (11).

13 Claims, 8 Drawing Sheets

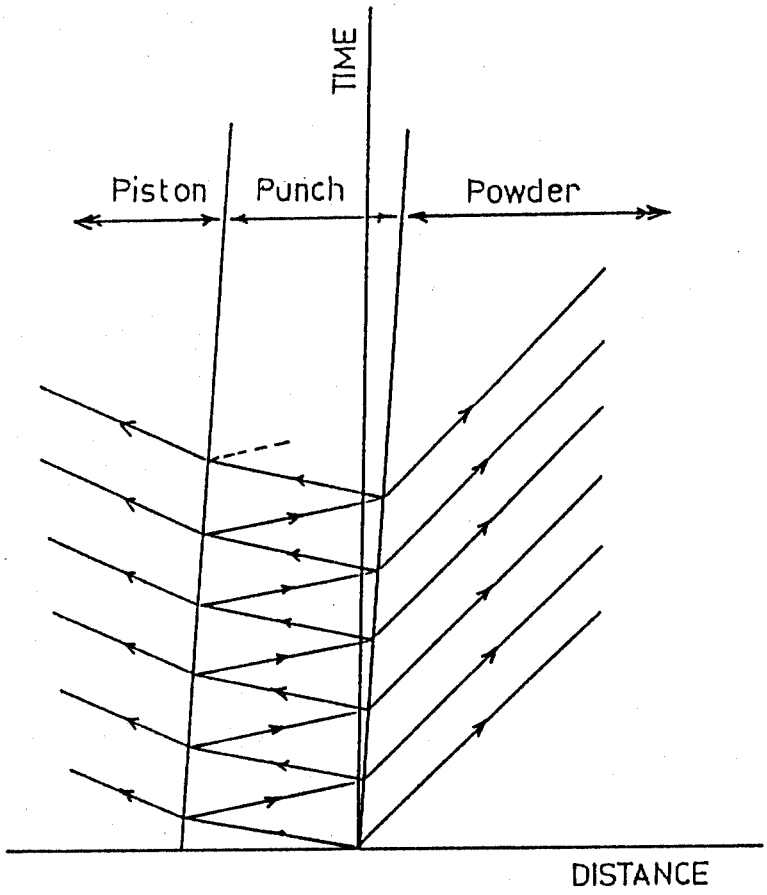
FIG 5A Wave Diagram-Punch attached to piston

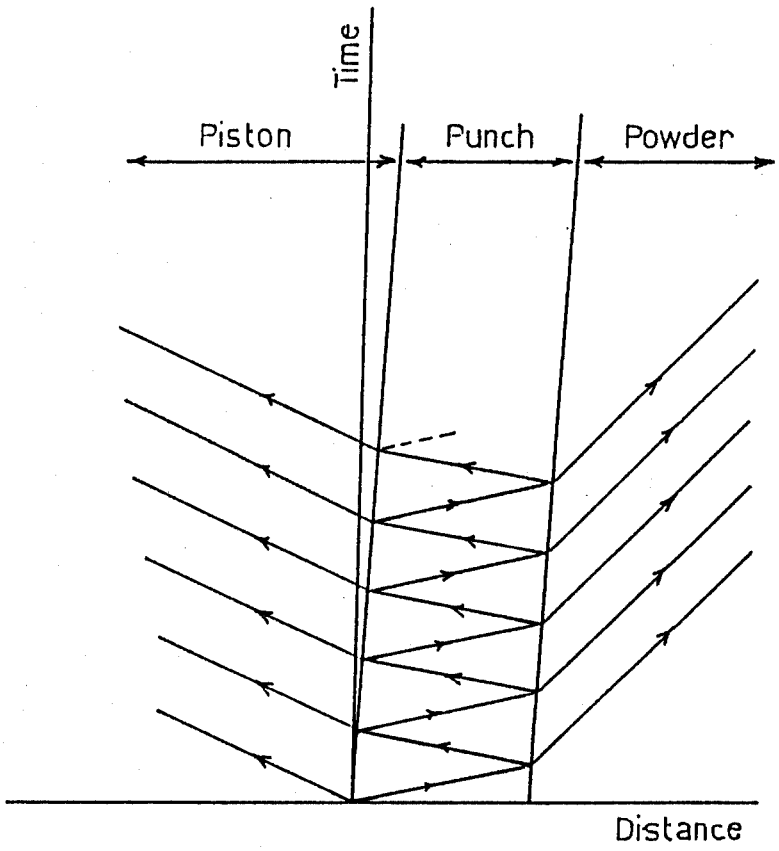
FIG 5B Wave Diagram- Punch adjacent to powder

Punch attached to piston

Punch adjacent powder

DYNAMICALLY LOADING SOLID MATERIALS OR POWDERS OF SOLID MATERIALS

FIELD OF THE INVENTION

This invention relates to the addition of an extra element into the path of stress waves present during the working or compaction of solid phase materials.

BACKGROUND ART

It is well established that materials can be shaped or compacted by impacting them with either a hammer or piston or punch or similar, e.g. see U.S. Pat. No. 4,255,374 issued Mar. 10, 1981, to Bo Lemcke et al and assigned to Institut Cerac S.A. The operation of this type of equipment is described in greater detail below.

OBJECT OF THE INVENTION

It is an object of the present invention to modify the propagation of stress waves in a material which is being dynamically loaded so as to gain greater control over the way in which the material is loaded compared to prior techniques. Other objects and advantages of the invention will hereinafter become apparent.

NATURE OF THE INVENTION

The invention provides a method of dynamically loading materials such as solid materials, or powders of solid materials, wherein the material is loaded in a support means and is impacted by a means generating a stress wave therein, characterised by the provision of an impedance means between the material and the means generating a stress wave, the impedance means being effective to cause reflection of stress waves within the material being dynamically loaded.

The invention also provides an apparatus for dynamically loading materials such as solid materials, or powders of solid materials, comprising a support means wherein the material is loaded, and a means generating stress waves therein characterised in that an impedance means is provided between the material and the means generating stress waves.

The impedance means may be applied directly to the means which generates stress waves or it may be located adjacent the material being stressed.

The purpose of the impedance means is to modify the propagation of stress waves by either (a) changing the way in which the stress (pressure) varies with time, or (b) producing higher compressive stresses (pressures) by changing the nature of stress wave reflections in the materials being worked, or both.

In the present specification the term 'solid phase' merely denotes a solid phase as distinct from a liquid or gas phase. Typical materials include metals, plastics, and ceramic. The term 'high shock impedance' merely implies that an impedance mismatch exists.

BRIEF DESCRIPTION OF THE DRAWINGS

FIGS. 5*a*and 5*b* show wave diagrams corresponding to the situation arising in operation of the apparatus of FIGS. 3 and 4 respectively.

DESCRIPTION OF PREFERRED EMBODIMENTS

For simplicity in the subsequent description, the invention will be described in terms of its application to the dynamic compaction (consolidation) of powdered materials but in principal it could also be applied to other processes utilizing stress waves caused by the impact of one body on another.

Figure 1:
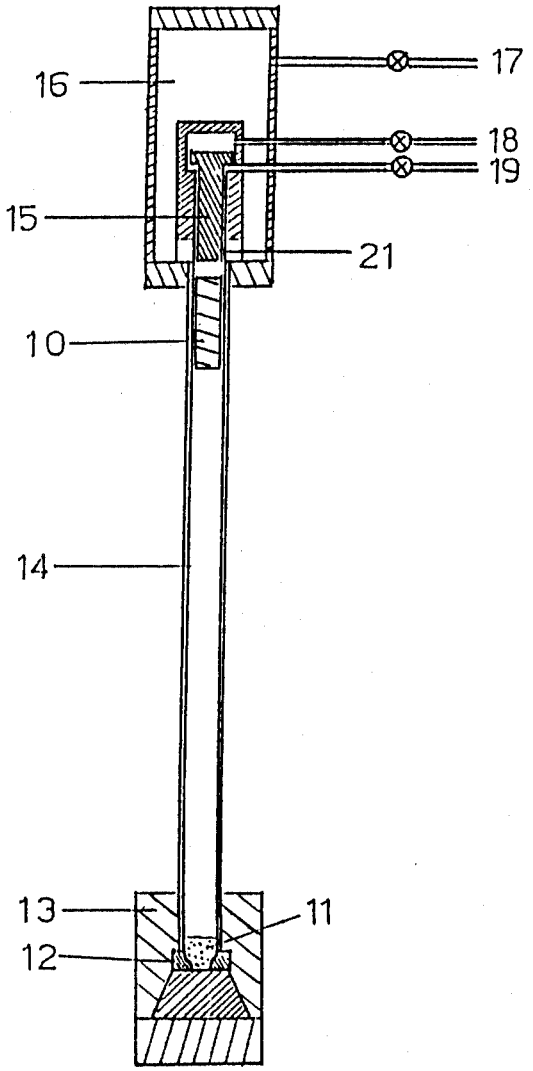
FIG. 1 is a schematic of an apparatus of a type to which the invention may be applied.

One method of dynamic powder compaction that lends itself to simple description of the invention utilizes a gas driven piston which is fired into powder constrained in a die (FIG. 1). On impact, an initial shock wave is formed in the powder. This is a compressive stress wave across which there is an abrupt increase in pressure. This propagates through the powder compressing it. Simultaneously there is a compressive stress wave formed in the piston which propagates back into the piston away from the piston/powder interface. This and subsequent wave behaviour is illustrated in FIG. 2.

In the apparatus of FIG. 1, a piston 10 is fired down a launch tube 14 at a powder 11 contained in a die insert 12 in a die block 13. The piston 10 is propelled by a high pressure gas in a reservoir 16 supplied from a valved supply 17. The piston is selectively operated by a fast acting valve 15 controlling an orifice 21 communicating the reservoir 16 with the launch tube 14. The fast acting valve is switched by pressurised gas in valved lines 18 and 19. Operation of valve 18 closes the fast acting valve and operation of valve 19 opens it.

The strength of the initial shock wave depends on the shock impedance of the piston material, the piston speed on impact and the pressure-density relation for the powder. To maximise the strength of the initial shock it is usually found that the best strategy is to maximise the piston speed on impact. However, given a fixed energy in the driver gas behind the piston, this means that, for a given kinetic energy in the piston, the lower the mass the higher is the speed. Thus, it is usual for the piston to be made of low density material.

The passage of the initial shock wave raises the powder from state 1 to state 2 with state 2 being characterised by high pressure ( as seen in FIG. 2). When the initial shock wave reaches the base of the die there is a reflected wave and a transmitted wave. Depending on the relative shock impedances of the powder and die materials, both the reflected and transmitted waves are usually compressive and there is a further compression of the powder to state 3 as the reflected wave propagates back towards the piston face. When the reflected wave arrives back at the piston face, there is a further reflection. In some situations it would be desirable for this reflected wave to also be compressive in nature leading to a further increase in pressure in the powder. However, with the light piston materials chosen to maximise the strength of the initial shock, the shock impedance of the piston is usually lower than that in the powder at state 2 and thus a tensile wave is reflected. One consequence of this is that the top layers of the resulting compact (i.e. those adjacent to the piston) do not weld adequately and have a loose flakey appearance. This occurs regularly when metal powders are being consolidated. For a compressive wave to be reflected at this stage, the shock impedance of the piston face materials must be higher than that in the powder. The invention described herein resides in the insertion of a relatively thin layer of high shock impedance material (which will be referred to as a "punch") between the piston and the powder so that the advantage of low piston mass is retained while the apparent shock impedance is raised. As will become more clear below, the thickness of the "punch" affects the time scale of events with thicker punches lengthening the time scale.

Figure 2B:
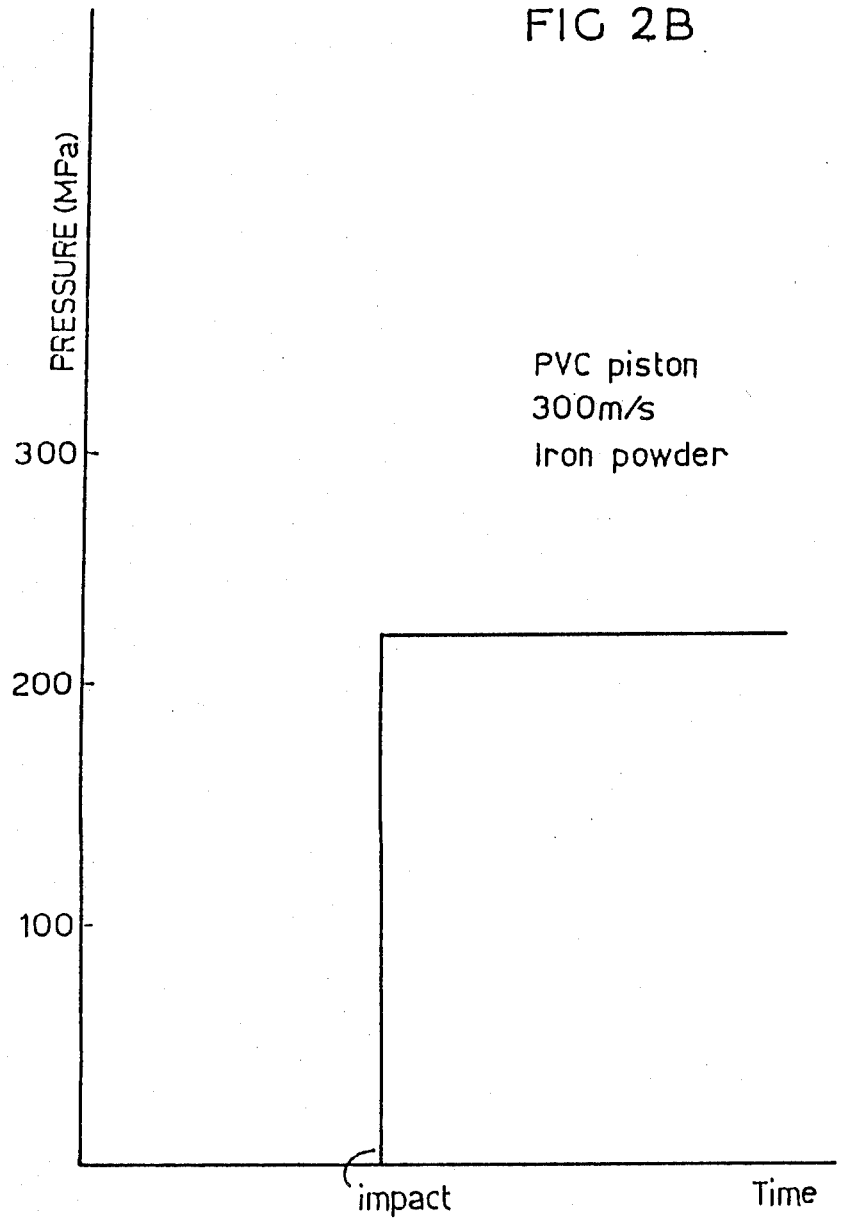
FIG. 2*b* graphically shows the pressure experienced by a powder under impact.
Figure 3:
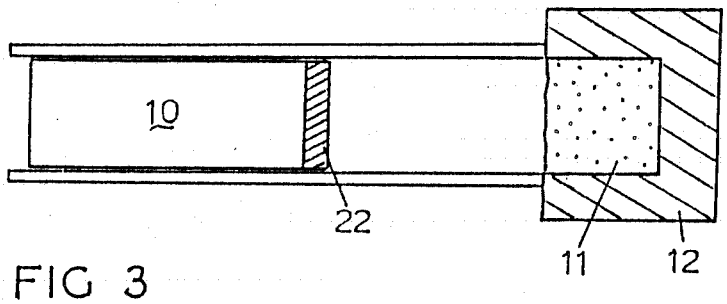
FIGS. 3 and 4 show two ways in which the invention may be applied in the working of powders.
Figure 4:
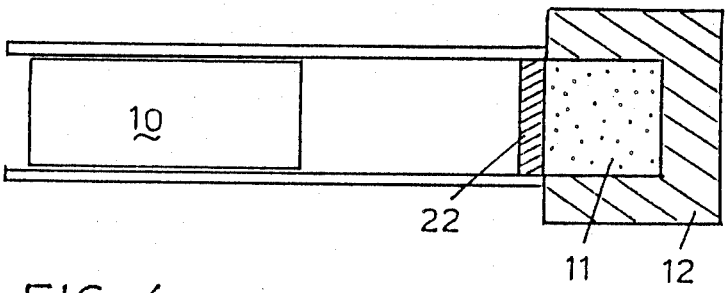
Figure 6A:
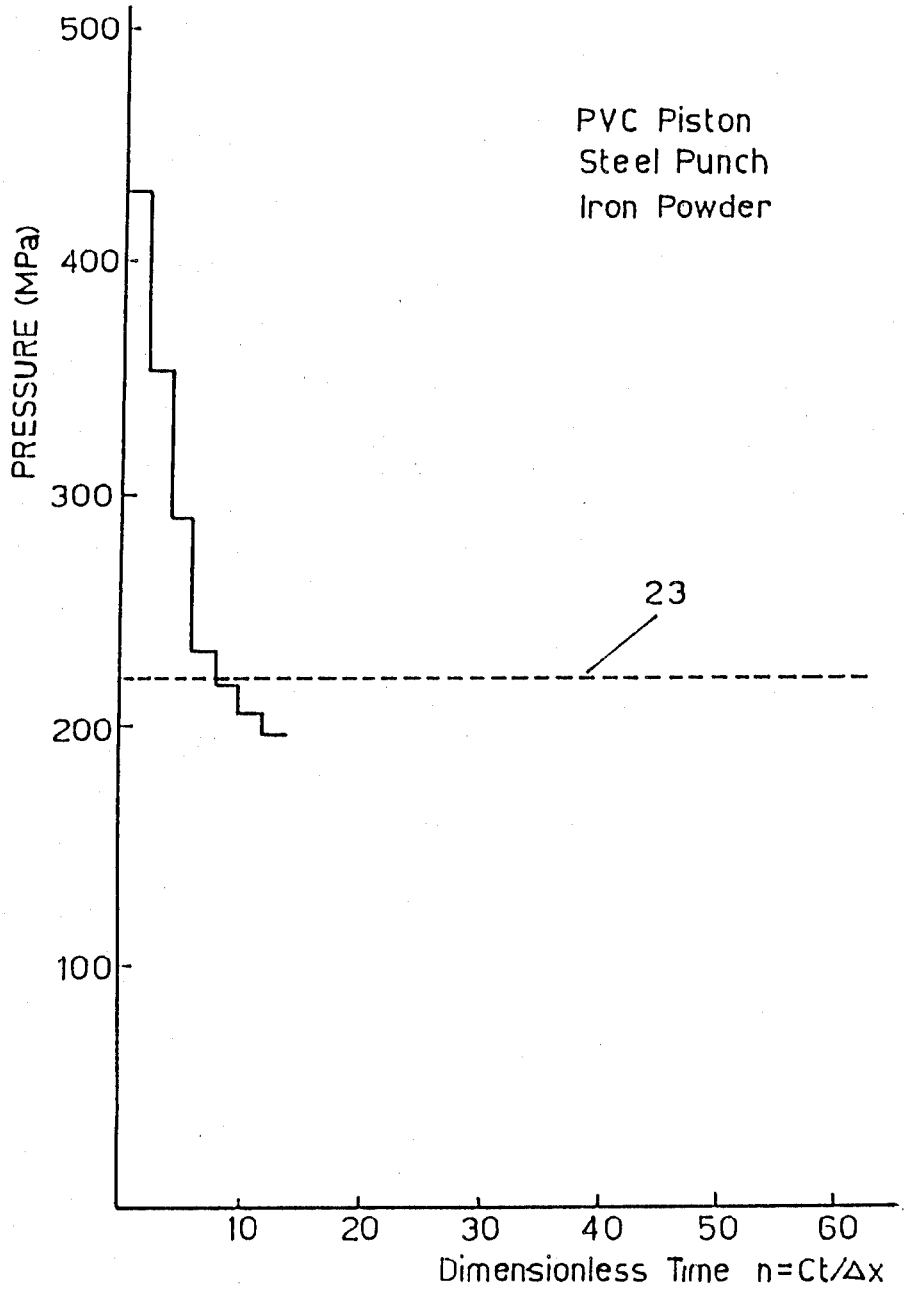
FIGS. 6*a* and 6*b* show the pressure variations arising in the material being worked in the apparatus of FIGS. 3 and 4 respectively.
Figure 6B:
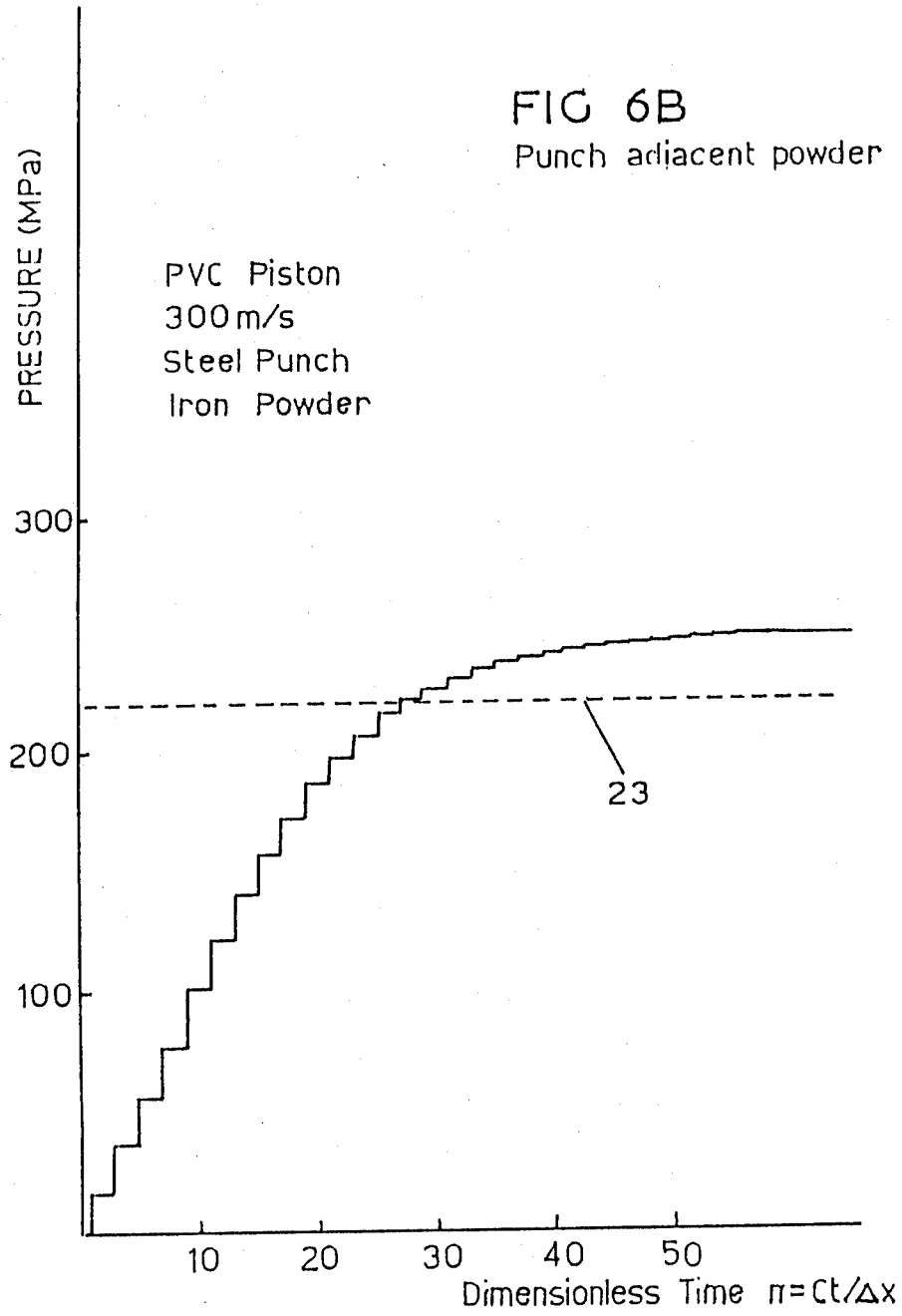

The "punch" 22 could initially be fixed to the piston 10, as shown in FIG. 3 or adjacent to the powder 11 as shown in FIG. 4. The resulting stress wave diagrams for both these cases are qualitatively similar but with the stress/shock waves starting at the punch/powder interface in case of the punch fixed to the front of the piston, and at the piston/punch interface for the case when the punch was initially adjacent to the powder. These two cases are shown in FIGS. 5*a* and 5*b* respectively. The main differences between the two cases lies in the different strength of the waves. Because of the addition of a layer of much higher shock impedance material to the front of the piston, the impact of the punch-faced piston onto the powder causes the generation of a much higher strength shock wave in the powder. However, the multiple reflections that subsequently take place in the punch send a series of tensile waves into the powder unloading it down to a pressure below that which would have been attained had no punch been present (i.e. as in FIG. 2*b*). The resulting pressure time history in the powder adjacent to the punch is shown in FIG. 6*a* in the absence of any reflected waves from the back of the die. Each step in pressure is separated by a time increment corresponding to the time taken for two traverses of the punch length by the stress wave (one in each direction). The corresponding pressure history for the second case with the punch initially adjacent to the powder is shown in FIG. 6*b*. In this case the pressure in the powder is initially low and, through the series of wave reflections in the punch, builds up to a value higher than that which would have been achieved had there been no punch present (i.e. as in FIG. 2*b*). The dotted line indicated at 23 indicates the result where no punch is present.

So, in addition to providing a highly reflective surface for stress waves in the powder, the punch also modifies the pressure-time history of the initial shock wave propagating into the powder. If the punch is attached to the piston, a much higher peak pressure is achieved in the powder but the pressure drops at a rate dependent on the thickness of the punch.

If the highest possible pressures are desired in the powder, the punch should be attached to the piston. However, the high pressures correspond to high particle velocities which may be undesirable in applications such as those involving powder flow into dies of complex shape. In such applications low powder velocities are desirable, and these can be achieved, also with high peak pressures, this time built up over a period of time by means of multiple stress wave reflections within the powder and punch, by placing the punch initially adjacent to the powder. The range of shapes which is possible is limited only by the need for a surface which is impacted so that die shapes with an opening of suitable dimension can be employed.

EXAMPLE

Two compacts were made from iron powder using a gas driven piston apparatus of the kind shown in FIG. 1. The compacts were simple cylindrical shapes about 25 mm. in diameter and 10 mm. deep. A piston made from PVC was employed and impacted at about 280 m/s in both cases. Compact (a) was directly impacted by the piston. It had a flakey top surface characteristic of all compacts made in this way. Its density was about 83% of the theoretical density for iron. Compact (b) had a steel punch of about 6 mm. length initially adjacent to the powder, as in FIG. 4. Otherwise it was an identical experiment to that producing compact (a). Compact (b) had an excellent top surface, indistinguishable from that on the bottom where the powder had been in contact with a fixed steel die. Compact (b) also had a density of about 88% of the theoretical density of iron.

Figure 2A:
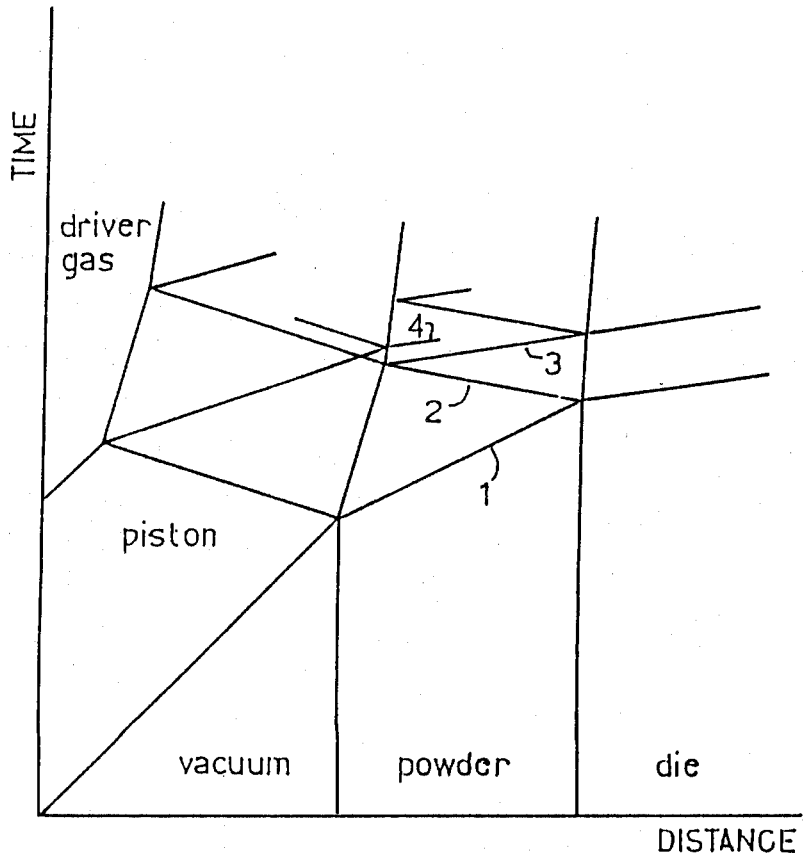
FIG. 2*a* is a wave diagram setting out the characteristic stresses to be encountered in a material being worked in the apparatus of FIG. 1.

The conclusion to be reached is that the extra compressive wave reflection, to state 4 in FIG. 2*a*, leads to the superior compact in case (b).

It will be readily apparent to the skilled addressee that the relative densities, masses and materials of the piston and punch, the impact velocity of the piston and the other design parameters of the apparatus will be determined to provide the most appropriate operating conditions for the particular application. However, the inclusion of the "punch" of the present invention produces marked improvement over the known apparatus referred to e.g. in the cited U.S. patent. Under certain conditions materials will flow and it is possible to cause solid blocks of material to flow under impact to fill out a die cavity. For example, where conditions are appropriate, some plastics can be moulded under impaction in a suitable die.

Various changes and modifications may be made to the embodiments described without departing from the present invention.

I claim:

1. A method of dynamically loading materials such as powders of solid materials, comprising the steps of:

(a) placing the material to be loaded in a support therefor, (b) positioning an impedance element externally of the material for reflecting stress waves within the material generated when the material is dynamically loaded, and (c) generating stress waves which act on said material through said impedance element, the impedance element transmitting stress waves between the generator of the stress waves and the material being loaded so as to control the timing and amplitude of stress waves entering the material, and wherein the impedance element is formed of a solid substance which, having regard to the composition of the material being loaded and the material from which the generator of the stress waves is formed, is such as to introduce an impedance mismatch to the passage of stress waves across the interface between the impedance element and the material, and the impedance element and the stress wave generator, during loading, the shock impedance of the impedance element being significantly higher than that of the material being loaded.

2. The method of claim 1, wherein the impedance element is carried by the stress wave generator and contacts the material during loading, thereby creating a relatively high initial stress wave presence in the material, which pressure is gradually unloaded due to wave reflections to a pressure below that which would exist without the impedance element.

3. The method of claim 1, wherein the impedance element abuts the material, the shock wave pressure initially created when the stress wave generator contacts the element being relatively low, and building up to a value higher than the pressure which would exist without the impedance element.

4. The method of claim 1 wherein the material being dynamically loaded comprises powders of at least two solid materials.

5. The method of claim 1 wherein said support is a die, the stress wave generator is a piston projected along a launch tube, and the impedance element is a plate-like body, the piston being driven into contact with the powder thereby generating a shock wave therein which is reflected internally of the powder off the powder/die and powder/plate-like body interfaces.

6. Apparatus for dynamically loading material such as powders of solid material, comprising:

(a) support means in which the powder material to be loaded is placed, (b) means for generating stress waves in said powder material and (c) impedance means between said generator means and the powder material for reflecting stress waves within the material when the material is dynamically loaded, and wherein said impedance means is formed of a substance which, having regard to the composition of the powder material being loaded and the material from which the means for generating stress waves is formed, is such as to introduce an impedance mismatch to passage of stress waves across the interface between the impedance means and the material, and the impedance means and the means for generating stress waves during loading, the shock impedance of the impedance element being significantly higher than that of the material being loaded, with the effect of controlling the timing and amplitude of the stress waves entering the material being loaded.

7. The apparatus of claim 6 wherein the support means is a die which opens into a launch tube, and said means for generating stress waves is a piston contained in said launch tube and which can be controllably projected towards said die.

8. The apparatus of claim 6 wherein said impedance means comprises a punch attached to the face of said piston directed towards the die.

9. The apparatus of claim 6 wherein said impedance means comprises a punch inserted into the die between the material therein and the piston.

10. The apparatus of claim 7 wherein the piston is projected toward said die by a high pressure gas from a supply thereof, the high pressure gas being selectively delivered to said launch tube behind said piston by a valve means.

11. The apparatus of claim 6 wherein the means for generating stress waves is a PVC piston projected down a launch tube by a pressurized gas which is selectively switched by a valve therefor, and said impedance means is a steel plate.

12. The apparatus of claim 11 wherein said steel plate is bonded to the PVC piston.

13. The apparatus of claim 11 wherein said steel plate is located adjacent the material to be struck by the PVC piston.

* * * * *